US010774595B2

(12) United States Patent
Russell et al.

(10) Patent No.: US 10,774,595 B2
(45) Date of Patent: Sep. 15, 2020

(54) EARTH-BORING TOOLS WITH REDUCED VIBRATIONAL RESPONSE AND RELATED METHODS

(71) Applicant: Baker Hughes, Houston, TX (US)

(72) Inventors: Steven Craig Russell, Sugar Land, TX (US); Kenneth R. Evans, Spring, TX (US)

(73) Assignee: Baker Hughes, Houston, TX (US)

( * ) Notice: Subject to any disclaimer, the term of this patent is extended or adjusted under 35 U.S.C. 154(b) by 233 days.

(21) Appl. No.: 15/914,405

(22) Filed: Mar. 7, 2018

(65) Prior Publication Data

US 2018/0266185 A1 Sep. 20, 2018

Related U.S. Application Data

(60) Provisional application No. 62/473,114, filed on Mar. 17, 2017.

(51) Int. Cl.

| | |
|---|---|
| ***E21B 10/43*** | (2006.01) |
| ***E21B 10/08*** | (2006.01) |
| ***E21B 10/00*** | (2006.01) |
| ***E21B 10/16*** | (2006.01) |
| ***E21B 10/42*** | (2006.01) |

(52) U.S. Cl.

CPC ..... *E21B 10/43* (2013.01); *E21B 10/00* (2013.01); *E21B 10/08* (2013.01); *E21B 10/16* (2013.01); *E21B 10/42* (2013.01); *E21B 2010/425* (2013.01)

(58) Field of Classification Search

CPC ..... E21B 10/00; E21B 10/08; E21B 10/16; E21B 10/42; E21B 10/43; E21B 2010/425

See application file for complete search history.

(56) References Cited

U.S. PATENT DOCUMENTS

| | | | | |
|---|---|---|---|---|
| 3,491,844 | A | 1/1970 | Kelly, Jr. | |
| 6,474,425 | B1 | 11/2002 | Truax et al. | |
| 6,834,733 | B1 * | 12/2004 | Maouche | E21B 10/55 175/378 |
| 8,439,136 | B2 | 5/2013 | Jones et al. | |
| 2007/0205023 | A1 | 9/2007 | Hoffmaster et al. | |
| 2012/0186879 | A1 | 7/2012 | Durairajan et al. | |

(Continued)

OTHER PUBLICATIONS

International Search Report for International Application No. PCT/US2018/021315 dated Jun. 26, 2018, 3 pages.

(Continued)

*Primary Examiner* — Tara E Schimpf
(74) *Attorney, Agent, or Firm* — TraskBritt

(57) ABSTRACT

Earth-boring tools may include a body, blades extending outward from the body, and cutting elements secured to the blades. An entirety of a first blade may exhibit a first, constant or continuously variable radius of curvature different from a second, constant or continuously variable radius of curvature of at least another portion of a second blade. Methods of making earth-boring tools may involve forming at least a portion of a first blade extending outward from a body to exhibit a first radius of curvature. An entirety of a second blade extending outward from the body may be formed to exhibit a second, different, constant or continuously variable radius of curvature. Cutting elements may be secured to the first and second blades.

18 Claims, 10 Drawing Sheets

(56) References Cited

U.S. PATENT DOCUMENTS

| | | | | |
|---|---|---|---|---|
| 2015/0122551 | A1 | 5/2015 | Chen | |
| 2015/0368979 | A1 | 12/2015 | Casad | |
| 2016/0032655 | A1* | 2/2016 | Boehm | E21B 10/43 175/57 |

OTHER PUBLICATIONS

International Written Opinion for International Application No. PCT/US2018/021315 dated Jun. 26, 2018, 8 pages.

* cited by examiner

EARTH-BORING TOOLS WITH REDUCED VIBRATIONAL RESPONSE AND RELATED METHODS

CROSS-REFERENCE TO RELATED APPLICATION

This application claims the benefit under 35 U.S.C. § 119(e) of U.S. Provisional Patent Application Ser. No. 62/473,114, filed Mar. 17, 2017, the disclosure of which is hereby incorporated herein in its entirety by this reference.

FIELD

This disclosure relates generally to tools for drilling boreholes in subterranean formations. More specifically, disclosed embodiments relate to earth-boring tools that may increase the stability of a drill string during drilling.

BACKGROUND

Earth-boring tools, such as, for example, fixed-cutter drill bits, hybrid bits, and reamers, may include a body having blades extending outward from the body. Cutting elements may be secured to the blades and positioned to engage with and remove an underlying earth formation in response to rotation of the earth-boring tools. When such earth-boring tools are used to drill in a borehole, the earth-boring tools and drill string to which they are attached may vibrate responsive to engagement with the formation under applied weight on bit (WOB) and torque applied through a drills string including, in some instances, a multi-component bottom hole assembly.

BRIEF SUMMARY

In some embodiments, earth-boring tools may include a body, blades extending outward from the body, and cutting elements secured to the blades. An entirety of a first blade may exhibit a first, constant or continuously variable radius of curvature different from a second, constant or continuously variable radius of curvature of an entirety of a second blade.

In other embodiments, methods of making earth-boring tools may involve forming an entirety of a first blade extending outward from a body to exhibit a first, constant or continuously variable radius of curvature. An entirety of a second blade extending outward from the body may be formed to exhibit a second, different, constant or continuously variable radius of curvature. Cutting elements may be secured to the first and second blades.

In still other embodiments, methods of drilling earth formations utilizing earth-boring tools may involve placing an earth-boring tool comprising a body, blades extending outward from the body, and cutting elements secured to the blades into a borehole in the earth formation. An entirety of a first blade may exhibit a first, constant or continuously variable radius of curvature different from a second, constant or continuously variable radius of curvature of an entirety of a second blade. An underlying earth formation may be removed utilizing the earth-boring tool while maintaining a peak amplitude at which the earth-boring tool vibrates at frequencies corresponding to multiples of n*rpm/60 Hz, where n is blade count, at about 75% or less of a peak amplitude at which a drill string including an earth-boring tool comprising blades having a same radius of curvature vibrates at frequencies corresponding to multiples of n*rpm/60 Hz.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular earth-boring tool or component thereof, but are merely idealized representations employed to describe illustrative embodiments. Thus, the drawings are not necessarily to scale.

Disclosed embodiments relate generally to earth-boring tools that may increase the stability of a drill string during drilling. More specifically, disclosed are embodiments of earth-boring tools that may include at least one blade having a radius of curvature different from a radius of curvature of at least another blade of the earth-boring tools.

As used in this disclosure, the term "earth-boring tool" means and includes any type of tool having cutting elements secured to blades of the tool and is configured for drilling during the creation or enlargement of a wellbore in a subterranean formation. For example, earth-boring tools include fixed cutter bits, eccentric bits, bicenter bits, mills, drag bits, hybrid bits, reamers, and other drilling bits and tools known in the art.

Figure 1:
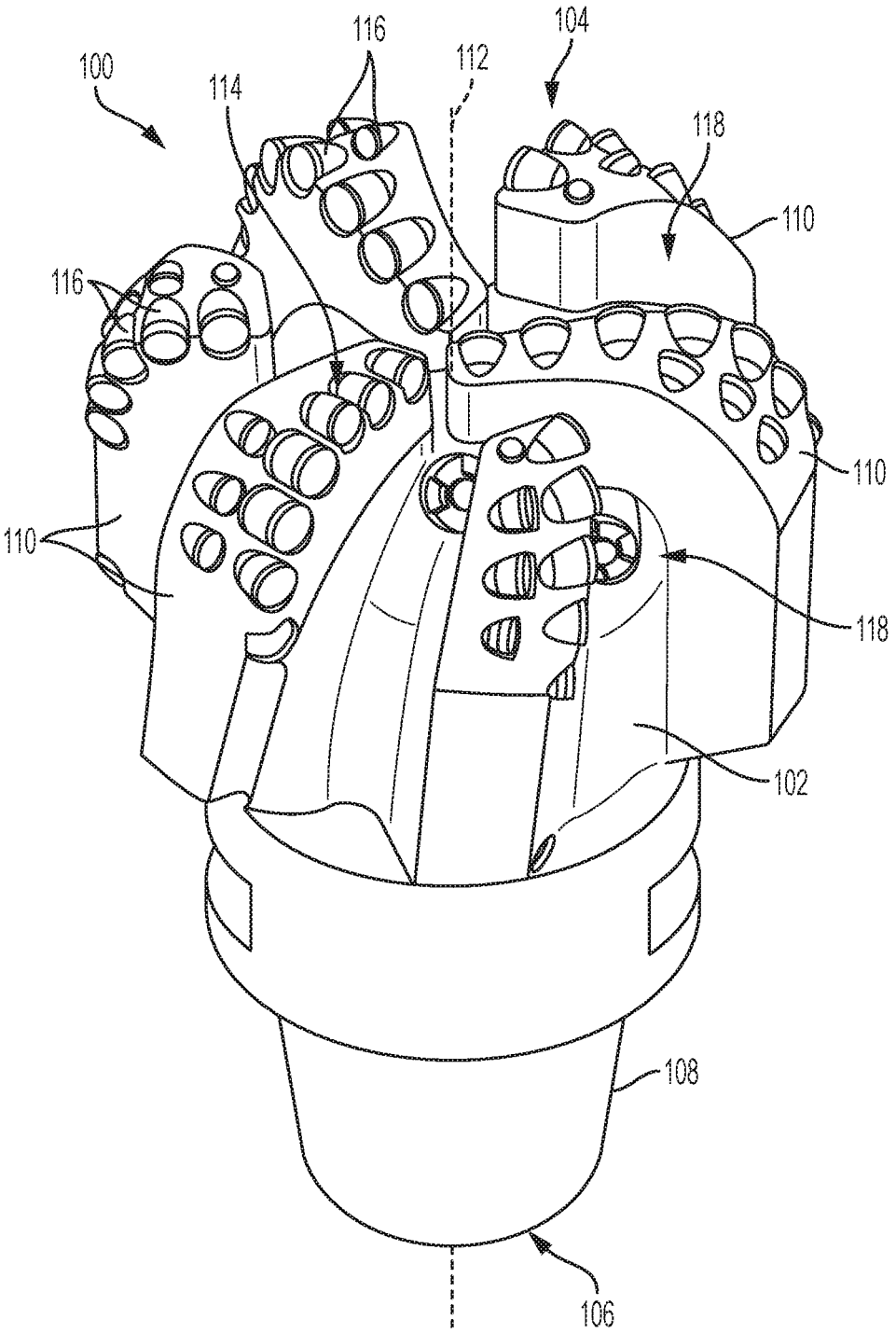
FIG. 1 is a perspective view of an earth-boring tool.

Referring to FIG. 1, a perspective view of an earth-boring tool 100 is shown. The earth-boring tool 100 shown in FIG.

1 may be configured as a fixed-cutter drill bit, although many of the features of the earth-boring tool 100 described herein may be incorporated into other types of earth-boring tools. The earth-boring tool 100 may include a body 102 having a leading end 104 and a trailing end 106. At the trailing end 106, the body 102 may include a connection member 108 (e.g., an American Petroleum Institute (API) threaded connection) configured to connect the earth-boring tool 100 to a drill string. At the leading end 104, the body 102 may include blades 110 extending axially outward from a remainder of the body 102 and radially outward with respect to a rotational axis 112, which may also be a central axis, of the body 102 across the leading end 104. A crown 114 of the body 102 of the earth-boring tool 100 may include an outer surcrown defined by the blades 110 and the remainder of the body 102 at the leading end 104 of the body 102. Junk slots 118 may be located circumferentially between adjacent blades 110 to enable cuttings generated by the earth-boring tool 100 to be removed by flowing drilling fluid. Cutting elements 116 may be secured to the blades 110 proximate the rotationally leading surcrowns of the blades 110, such that the cutting elements 116 may be positioned to engage with, and remove, an underlying earth formation.

Figure 2:
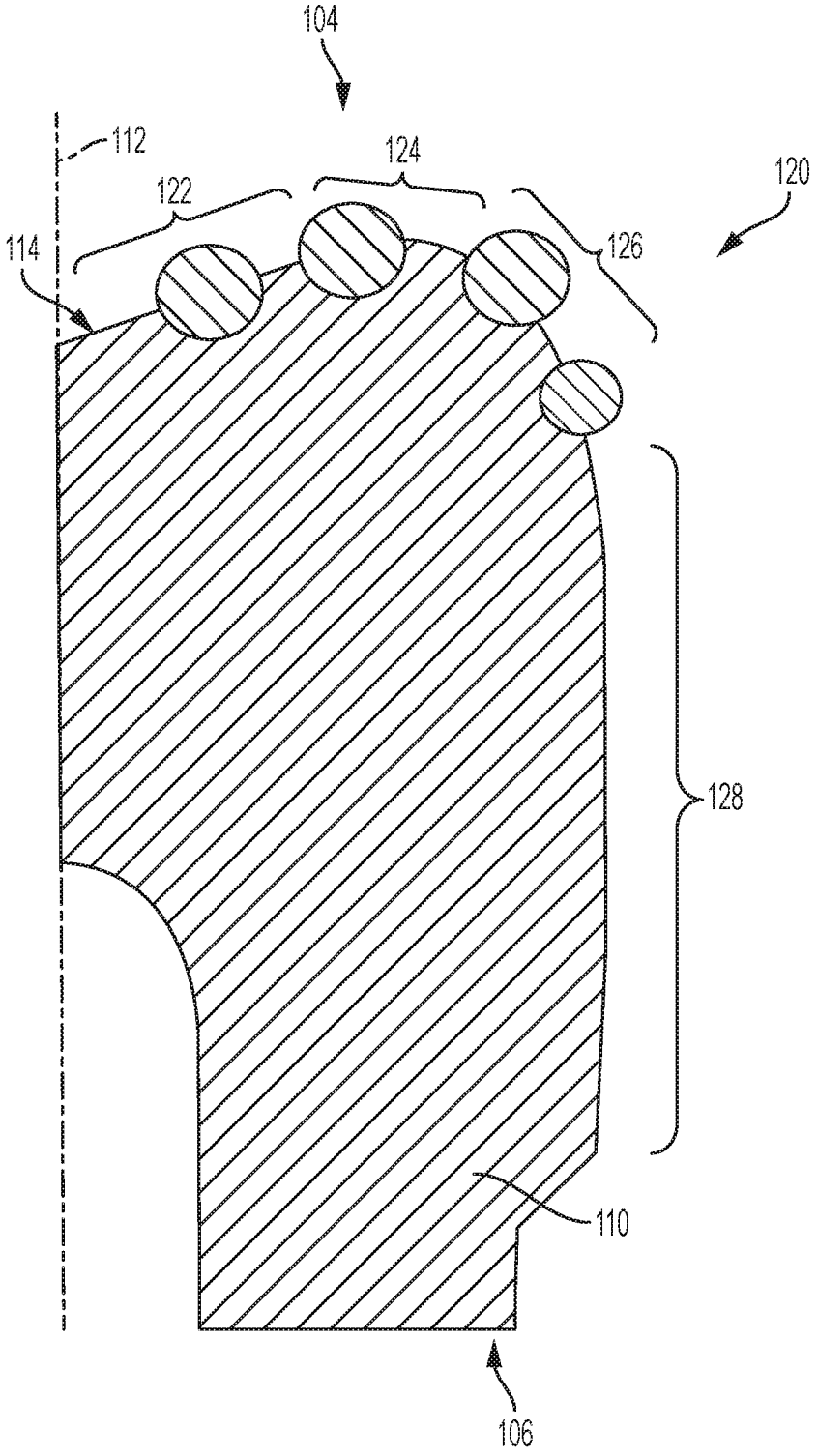
FIG. 2 is a partial cutaway side view of a portion of the earth-boring tool of FIG. 1.

FIG. 2 is a partial cutaway side view of a portion 120 of the earth-boring tool 100 of FIG. 1. Each blade 110 may include several regions located radially between the rotational axis 112 and the periphery of the earth-boring tool 100 (see FIG. 1). For example, at least some blades 110 may include a cone region 122 located immediately around the rotational axis 112. The cone region 122 may be characterized by a sloping surcrown extending at an at least substantially constant slope away from the trailing end 106 toward an underlying earth formation. A nose region 124 may be located adjacent to the cone region 122 on a side of the cone region 122 opposite the rotational axis 112. The nose region 124 may be characterized by a gradually changing slope terminating when the slope of the nose region is at least substantially perpendicular to the rotational axis 112. A shoulder region 126 may be located adjacent to the nose region 124 on a side of the nose region 124 opposite the cone region 122. The shoulder region 126 may be characterized by a gradually changing slope beginning to extend from perpendicular to the rotational axis 112 toward the trailing end 106. A gage region 128 may be located adjacent to the shoulder region 126 on a side of the shoulder region 126 opposite the nose region 124. The gage region 128 may located at the periphery of the earth-boring tool 100. The cutting elements 116 may be located in at least one, and up to all, of the aforementioned regions 122 through 128 of a given blade 110. The junk slots 118 (see FIG. 1) may extend from the gage region 128, through the shoulder region 126 and the nose region 124, to the cone region 122, such that there remains circumferential space between each adjacent blade 110.

Figure 3:
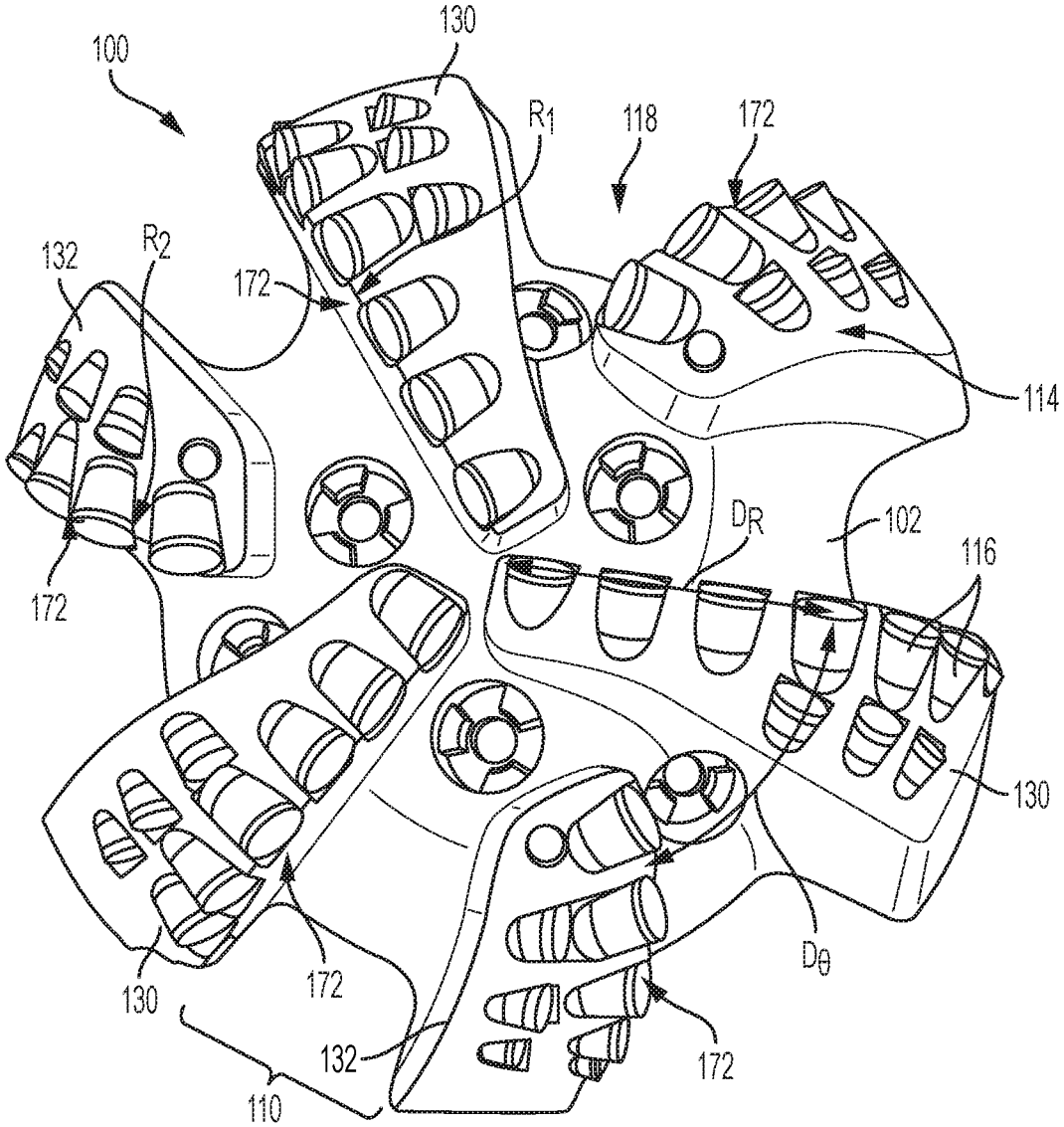
FIG. 3 is an end view of a crown of the earth-boring tool of FIG. 1.

FIG. 3 is a perspective view of the crown 114 of the earth-boring tool 100 of FIG. 1. As shown in FIG. 3, the earth-boring tool 100 may include at least one first blade 130, (which may be configured, and referred to, as a "primary blade 130), at least a portion of which may have a first radius of curvature $R_1$, which may be defined as set forth below in the paragraph explaining how to calculate the radius of curvature of a blade of an earth-boring tool. More specifically, at least a portion of the first blade 130 or first blades 130 may have the first radius of curvature $R_1$, which may be constant (e.g., forming a portion of a circle), or continuously variable (e.g., having a smooth arc to its curvature), at least over the radial extent of the relevant portion. In other words, the portion of the first blade 130 or first blades 130 having the first radius of curvature $R_1$ may be at least substantially free of or lack discontinuities in its curvature (e.g., may not have any points of intersection between two lines or smooth curves, jagged transitions, or sawtooth peaks). As a specific, nonlimiting example, the first blade 130 or first blades 130 may include at least one portion spanning at least one of the cone region 122, the nose region 124, the shoulder region 126, and the gage region 128 (see FIG. 2), the portion having the constant or continuously variable first radius of curvature $R_1$. In some embodiments, such as that shown in FIG. 3, the earth-boring tool 100 may include, for example, a set of first blades 130, each of the first blades 130 exhibiting the first radius of curvature $R_1$ over at least substantially an entirety of a radial extent of each first blade 130. As a specific, nonlimiting example, the primary blades 130 of the earth-boring tool 100 may all exhibit a constant, first radius of curvature $R_1$. The primary blades 130 may extend from the cone region 122 (see FIG. 2) radially outward over the crown 114 to the gage region 128 (see FIG. 2). The primary blades 130 may include cutting elements 116 secured to the primary blades 130 in each of the regions from the cone region 122 (see FIG. 2) through the gage region 128 (see FIG. 2).

The earth-boring tool 100 may include at least one second blade 132, (which may be configured, and referred to, as a "secondary blade 132), at least a portion of which may have a second, different radius of curvature $R_2$. More specifically, at least a portion of the second blade 132 or second blades 132 may have the second radius of curvature $R_2$, which may also be constant (e.g., forming a portion of a circle), or continuously variable (e.g., having a smooth arc to its curvature), and different in magnitude at least over the radial extent of the relevant portion. In other words, the portion of the second blade 132 or second blades 132 having the second, different radius of curvature $R_2$ may be at least substantially free of or lack discontinuities in its curvature (e.g., may not have any points of intersection between two lines or smooth curves, jagged transitions, or sawtooth peaks). As a specific, nonlimiting example, the second blade 132 or second blades 132 may include at least one portion spanning at least one of the cone region 122, the nose region 124, the shoulder region 126, and the gage region 128 (see FIG. 2), the portion having the constant or continuously variable second, different radius of curvature $R_2$. In some embodiments, such as that shown in FIG. 3, the earth-boring tool 100 may include, for example, a set of second blades 132, each of the second blades 132 exhibiting the second radius of curvature $R_2$ over at least substantially an entirety of a radial extent of each second blade 132. As a specific, nonlimiting example, the secondary blades 132 of the earth-boring tool 100 may all exhibit a constant, second radius of curvature $R_2$. The second blades 132 may not include a cone region 122, but may extend from the nose region 124 (see FIG. 2) or the shoulder region 126 (see FIG. 2) radially outward over the crown 114 to the gage region 128 (see FIG. 2). The secondary blades 132 may include cutting elements 116 secured to the secondary blades 132 in each of the regions from the nose region 124 (see FIG. 2) or the shoulder region 126 (see FIG. 2) through the gage region 128 (see FIG. 2).

As shown in FIG. 3, the first blades 130 may be straighter than the second blades 132. As also shown in FIG. 3, the first blades 130 and the second blades 132 may exhibit an at least substantially constant radius of curvature from the portion of the respective first blade 130 or second blade 132 closest to the rotational axis 112 to the gage region 128 (see FIG. 2)

For example, the first radius of curvature $R_1$ of the first blades 130 may be greater than the second radius of curvature $R_2$ of the second blades 132. The first radius of curvature $R_1$ may be, for example, between about 125% and about infinity% (i.e., in an embodiment where the first blades 130 are straight) of the second radius of curvature $R_2$. More specifically, the first radius of curvature $R_1$ may be, for example, between about 200% and about 7,500% of the second radius of curvature $R_2$. As a specific, nonlimiting example, first radius of curvature $R_1$ may be between about 830% and about 6,250% (e.g., about 1,000%, 2,500%, or 5,000%) of the second radius of curvature $R_2$. As additional examples, the first radius of curvature $R_1$ may be, for example, between about 15 inches and about infinity (i.e., straight). More specifically, the first radius of curvature $R_1$ may be, for example, between about 25 inches and about 150 inches. As a specific, nonlimiting example, the first radius of curvature $R_1$ may be between about 50 inches and about 125 inches (e.g., about 100 inches). The second radius of curvature $R_2$ may be, for example, between about 1 inch and about 12 inches. More specifically, the second radius of curvature $R_2$ may be, for example, between about 2 inches and about 10 inches. As a specific, nonlimiting example, second radius of curvature $R_2$ may be between about 3 inches and about 6 inches (e.g., about 4 inches).

In other embodiments, the first blades 130 may be less straight than the second blades 132. For example, the first radius of curvature $R_1$ of the first blades 130 may be less than the second radius of curvature $R_2$ of the second blades 132. The first radius of curvature $R_1$ may be, for example, between about 0% (i.e., in an embodiment where the first blades 130 are straight) and about 80% of the second radius of curvature $R_2$. More specifically, the first radius of curvature $R_1$ may be, for example, between about 1% and about 40% of the second radius of curvature $R_2$. As a specific, nonlimiting example, first radius of curvature $R_1$ may be between about 2% and about 25% (e.g., about 4%, 5%, 10%, or 15%) of the second radius of curvature $R_2$. As additional examples, the first radius of curvature $R_1$ may be, for example, between about 1 inch and about 12 inches. More specifically, the first radius of curvature $R_1$ may be, for example, between about 2 inches and about 10 inches. As a specific, nonlimiting example, first radius of curvature $R_1$ may be between about 3 inches and about 6 inches (e.g., about 4 inches or 5 inches). The second radius of curvature $R_2$ may be, for example, between about 15 inches and about infinity (i.e., straight). More specifically, the second radius of curvature $R_2$ may be, for example, between about 25 inches and about 150 inches. As a specific, nonlimiting example, second radius of curvature $R_2$ may be between about 50 inches and about 125 inches (e.g., about 75 inches or 100 inches).

The first radius of curvature $R_1$ of the relevant portion of the first blades 130 and the second radius of curvature $R_2$ of the relevant portion of the second blades 132 may be calculated, for example, by forming a least squares fit curve to a series of points located equidistant at the rotationally leading surface 172 of the given first blade 130 or second blade 132 in a plane perpendicular to the rotational axis 112 throughout the relevant regions 122 through 128 (see FIG. 2). Because the first radius of curvature $R_1$ of the first blades 130 and the second radius of curvature $R_2$ of the second blades 132 shown in FIG. 3 may be at least substantially constant, the first radius of curvature $R_1$ of the first blades 130 may be calculated from the cone region 122 (see FIG. 2) through the gage region 128 (see FIG. 2), and the second radius of curvature $R_2$ of the second blades 132 may be calculated from the nose region 124 (see FIG. 2) or the shoulder region 126 (see FIG. 2) through the gage region 128 (see FIG. 2). In other embodiments, the first blades 130 and second blades 132 may have the same radius of curvature in certain portions (e.g., regions 122 through 128 (see FIG. 2)), and different radiuses of curvature $R_1$ and $R_2$ in other portions. In such embodiments, the first radius of curvature $R_1$ and the second radius of curvature $R_2$ may only be calculated over those radial distances where the first blades 130 and second blades 132 have different radiuses of curvature and there is no discontinuity in the smooth curvatures of the first blades 130 and the second blades 132. For example, the relevant portions in such embodiments may be those portions within the same radial extents of the leading end 104 (e.g., within specific ones of the regions 122 through 128 (see FIG. 2), combinations of the regions 122 through 128 (see FIG. 2), a subsection or subsections of one or more of the regions 122 through 128 (see FIG. 2), or combinations of one or more of the regions 122 through 128 (see FIG. 2) with a subsection or subsections of one or more of the other regions 122 through 128 (see FIG. 2)) having different radiuses of curvature within those radial extents and exhibiting a constant or continuous arc.

In some embodiments, such as that shown in FIG. 3, the number of first blades 130 may be equal to the number of second blades 132. In other embodiments, the number of first blades 130 may be greater than, or less than, the number of second blades 132. For example, the number of first blades 130 may range from one, through the total number of other possibilities, to all but one, and vice versa for the second blades 132.

In additional embodiments, there may be more than two groupings of blades having different radiuses of curvature. For example, at least a portion of each blade on an earth-boring tool may exhibit a different radius of curvature from at least a portion of each other radius of curvature of each other blade. As another example, an earth boring tool may include a first blade or first set of blades having at least a portion exhibiting a first radius of curvature, a second blade or second set of blades having at least a portion exhibiting a second, different radius of curvature, an optional third blade or third set of blades having at least a portion exhibiting a third, still different radius of curvature, an optional fourth blade or fourth set of blades having at least a portion exhibiting a fourth, yet different radius of curvature, etc.

Figure 4:
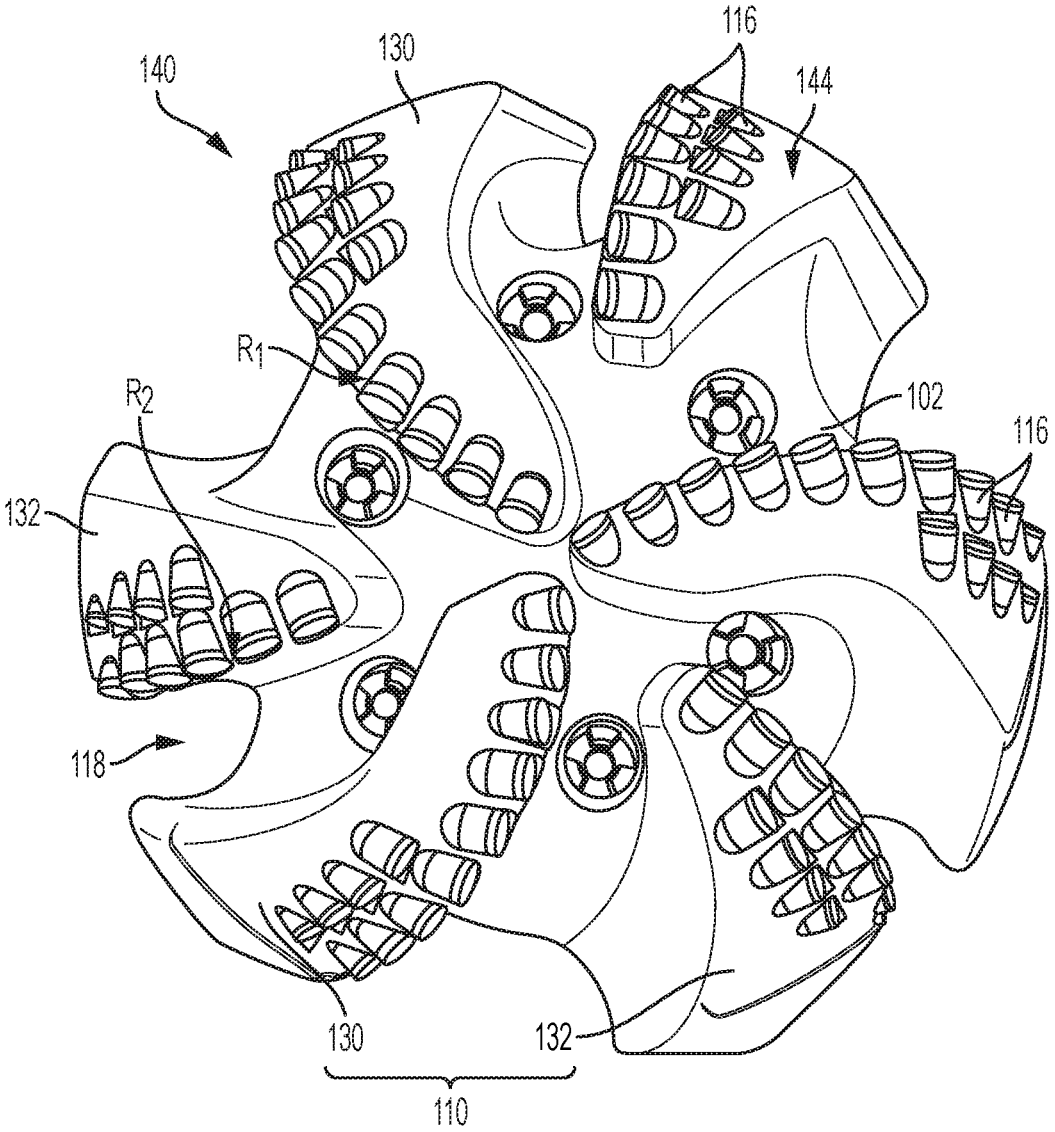
FIG. 4 is a an end view of a crown of another embodiment of an earth-boring tool in accordance with this disclosure.

FIG. 4 is a perspective view of a crown 144 of another embodiment of an earth-boring tool 140 in accordance with this disclosure. The first blades 130 of the earth-boring tool 140 may also be primary blades, and the second blades 132 of the earth-boring tool 140 may likewise be secondary blades. In addition, the number of first blades 130 may be equal to the number of second blades 132.

As shown in FIG. 4, the first blades 130 may be more curved than the second blades 132 in some embodiments. More specifically, the first radius of curvature $R_1$ of the first blades 130 may be, for example, less than the second radius of curvature $R_2$ of the second blades 132. The first radius of curvature $R_1$ may be, for example, between about 1 inches and about 12 inches. More specifically, the first radius of curvature $R_1$ may be, for example, between about 2 inches and about 10 inches. As a specific, nonlimiting example, first radius of curvature $R_1$ may be between about 3 inches and about 6 inches (e.g., about 4 inches). The second radius of curvature $R_2$ may be, for example, between about 15 inches and about infinity (i.e., straight). More specifically, the second radius of curvature $R_2$ may be, for example, between about 25 inches and about 150 inches. As a specific, nonlimiting example, second radius of curvature $R_2$ may be between about 50 inches and about 125 inches (e.g., about 100 inches).

Figure 5:
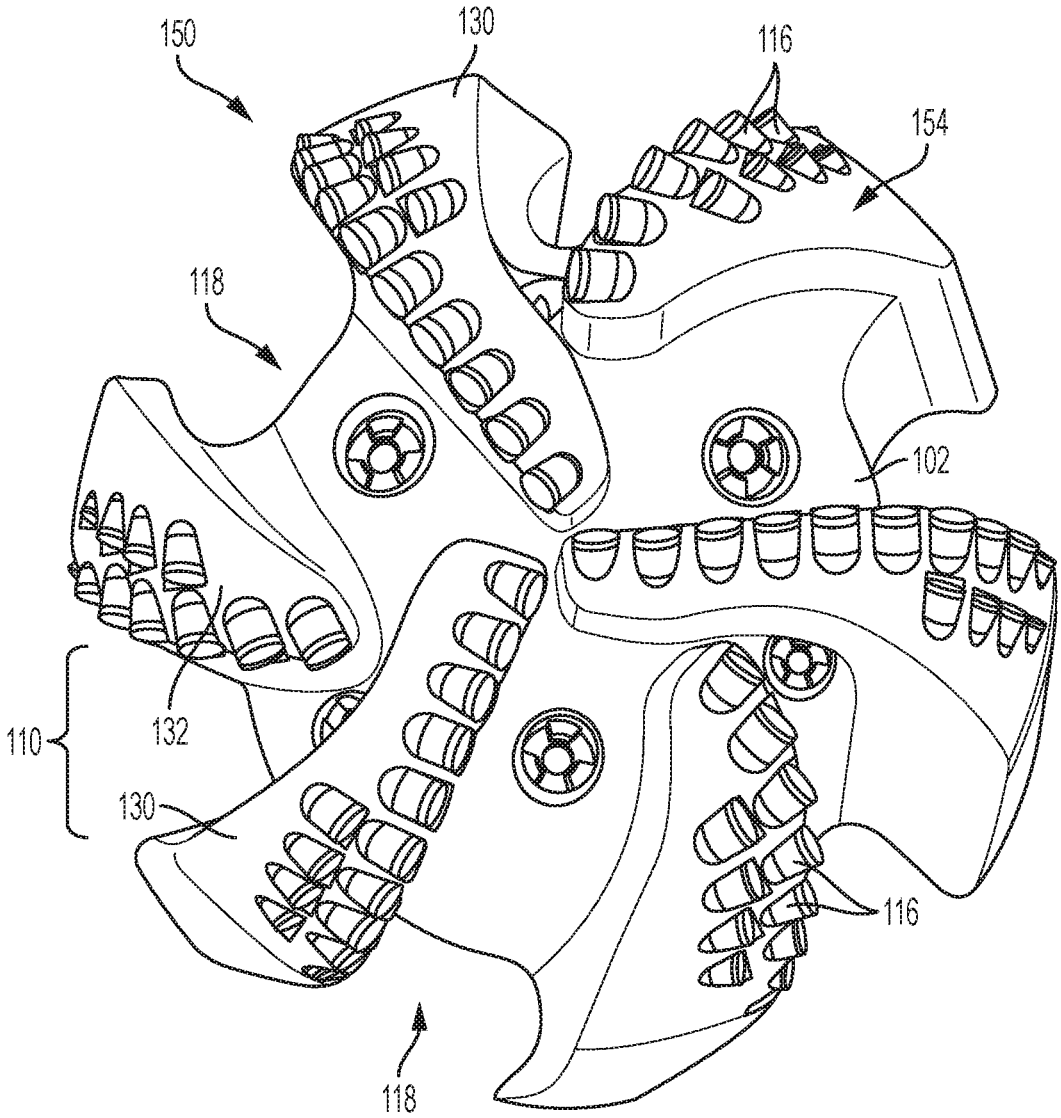
FIG. 5 is an end view of a crown of yet another embodiment of an earth-boring tool in accordance with this disclosure.

FIG. 5 is a perspective view of a crown 154 of yet another embodiment of an earth-boring tool 150 in accordance with this disclosure. The earth-boring tool 150 may be configured in a manner at least substantially similar to that of FIGS. 1 through 3. As shown in FIG. 5, the first blades 130 may directly extend to rotationally trailing second blades 132. In other words, the junk slots 118 may extend from the gage region 128 (see FIG. 2), through the shoulder region 126 (see FIG. 2), to the nose region 124 (see FIG. 2) or to the cone region 122 (see FIG. 2), such that the crown 154 extends circumferentially between the respective first blades 130 and their rotationally trailing second blades 132.

Figure 6:
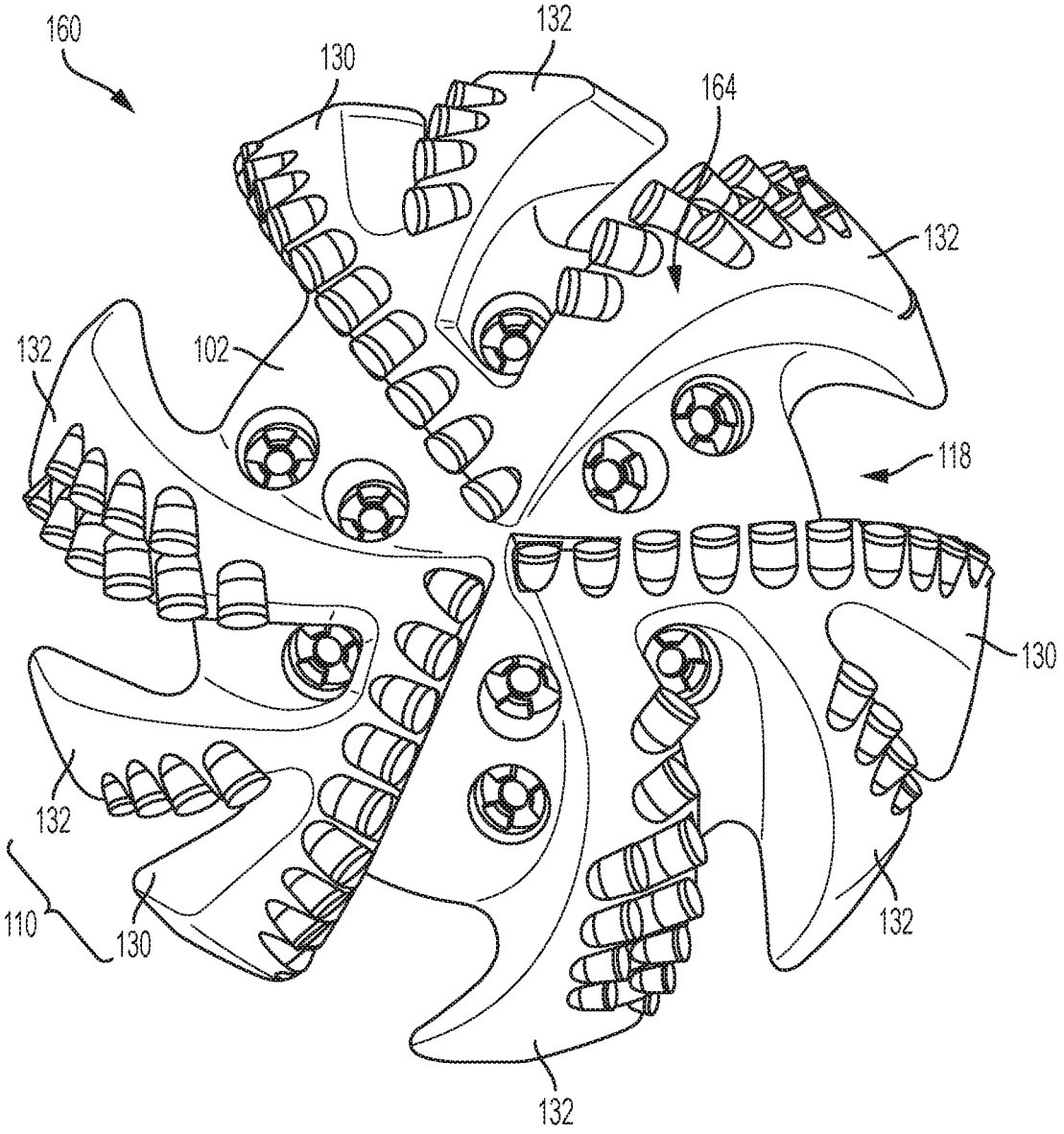
FIG. 6 is an end view of a crown of still another embodiment of an earth-boring tool in accordance with this disclosure.

FIG. 6 is a perspective view of a crown 164 of still another embodiment of an earth-boring tool 160 in accordance with this disclosure. In some embodiments, such as that shown in FIG. 6, the number of first blades 130 may not be the same as the number of second blades 132. For example, the number of second blades 132 may be greater than the number of first blades 130, as shown in FIG. 6. In other example embodiments, the number of second blades 132 may be less than the number of first blades 130.

Figure 7:
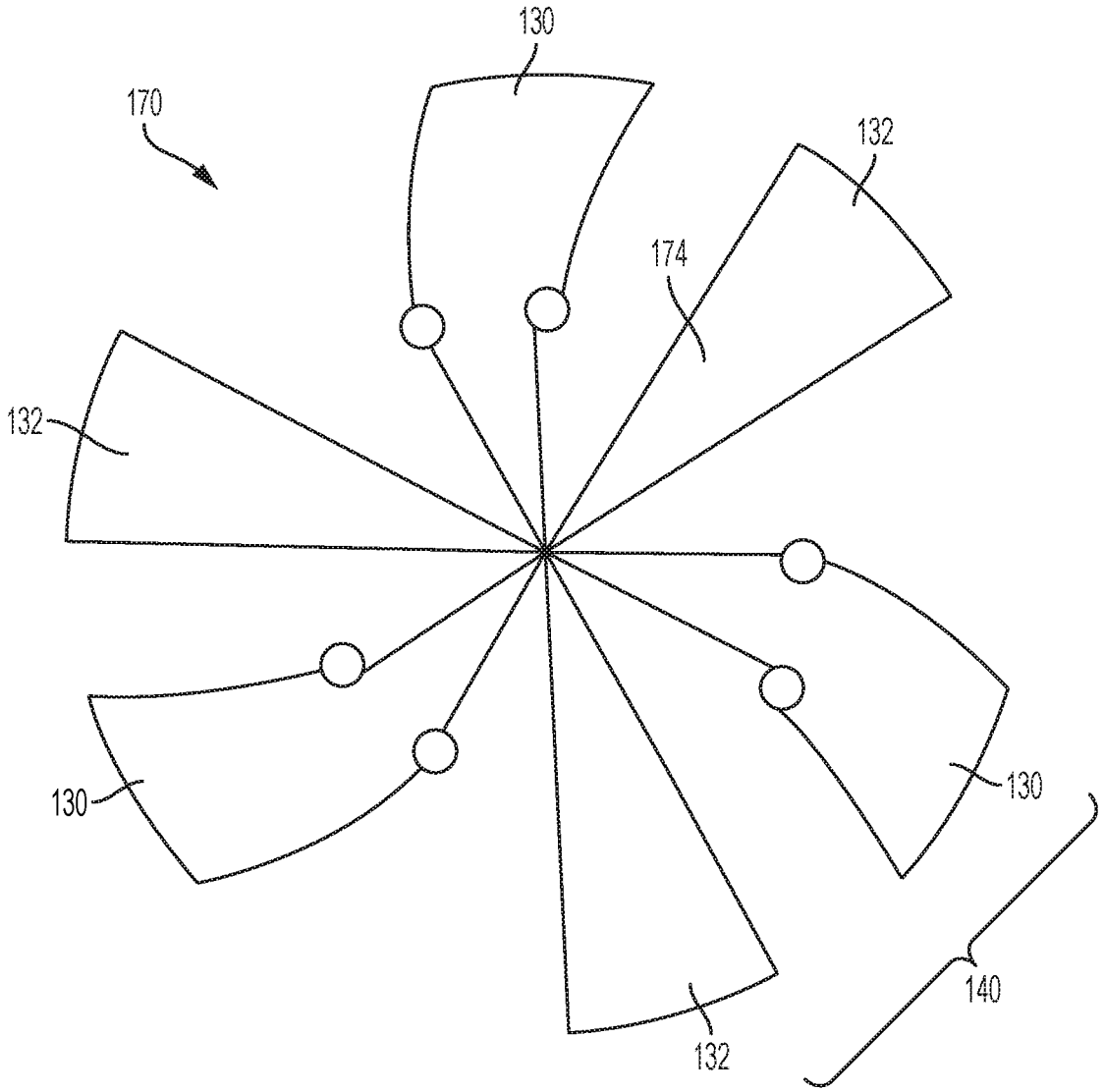
FIG. 7 is a schematic end view of yet another embodiment of an earth-boring tool in accordance with this disclosure.

FIG. 7 is a schematic end view of yet another embodiment of an earth-boring tool 170 in accordance with this disclosure. In some embodiments, such as that shown in FIG. 7, the difference in radius of curvature between the first blades 130 and the second blades 132 may only exist in certain portions (e.g., ones of the regions 122 through 128 (see FIG. 2), combinations of the regions 122 through 128 (see FIG. 2), a subsection or subsections of one or more of the regions 122 through 128 (see FIG. 2), or combinations of one or more of the regions 122 through 128 (see FIG. 2) with a subsection or subsections of one or more of the other regions 122 through 128 (see FIG. 2)) of the crown 174. For example, the radius of curvature of the portions of the second blades 132 that extend into the cone region 122 (see FIG. 2) may be at least substantially equal to the radius of curvature of the portions of the first blades 130 located in the cone region 122 (see FIG. 2). In other words, the first blades 130 and the second blades 132 may both have the first radius of curvature $R_1$ in one or more of the regions 122 through 128 (see FIG. 2). However, the portions of the second blades 132 located in the nose region 124 (see FIG. 2) through the gage region 128 (see FIG. 2) or in the shoulder region 126 (see FIG. 2) and the gage region 128 (see FIG. 2) may have the second radius of curvature $R_2$ that is different from the first radius of curvature $R_1$ of the first blades 130 in the same regions.

Figure 8:
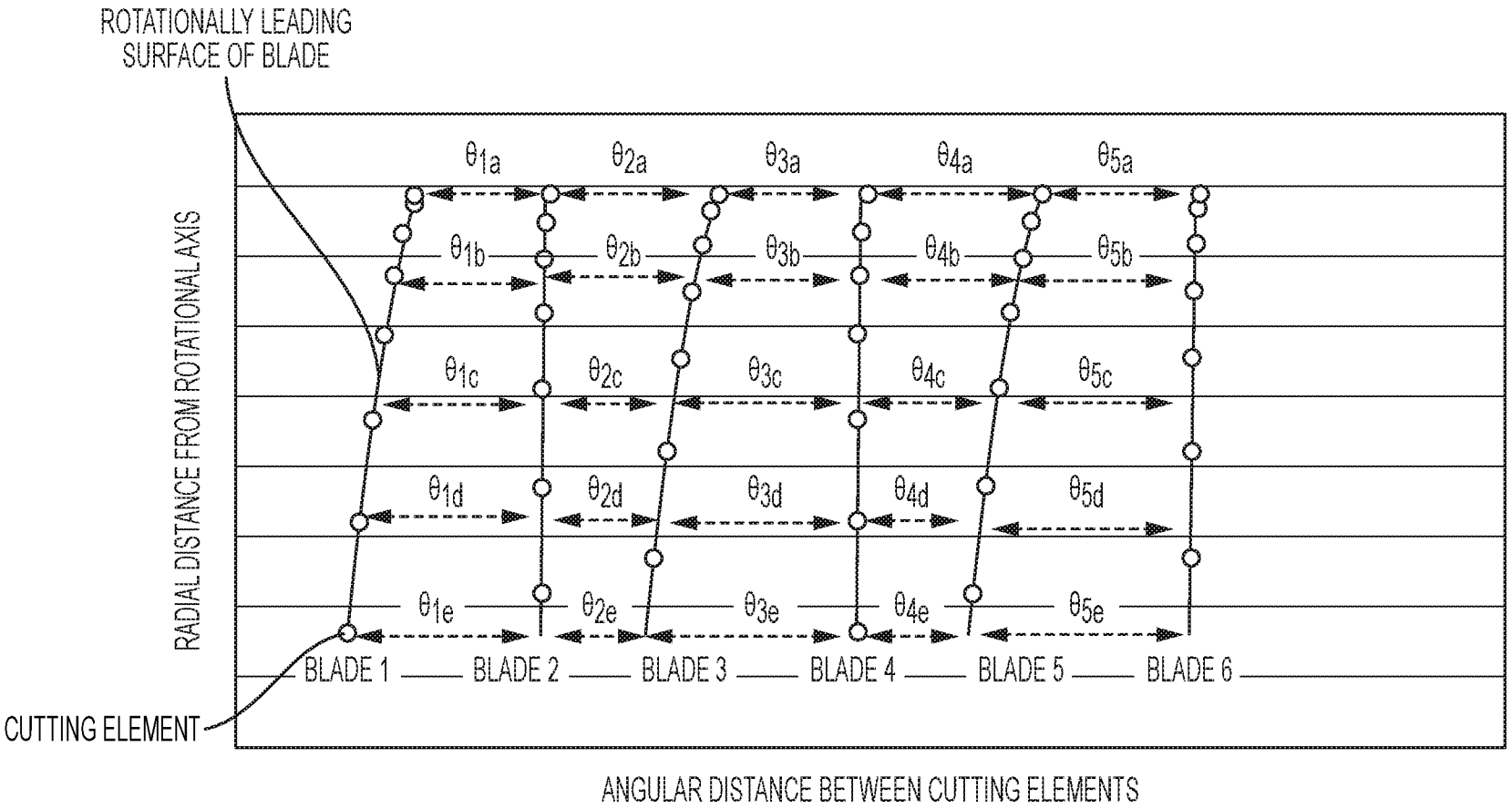
FIG. 8 is a chart depicting an angular distance between cutting elements on circumferentially adjacent blades of an embodiment of an earth-boring tool in accordance with this disclosure.

FIG. 8 is a chart depicting an angular distance $D_\theta$ (see FIG. 3) between rotationally leading surfaces 172 (see FIG. 3) of circumferentially adjacent blades of an embodiment of an earth-boring tool in accordance with this disclosure. As shown in FIGS. 3 and 8, changing the radius of curvature of at least one of the blades 110 of the earth-boring tool 100 may increase the variance in distances between rotationally leading surfaces 172 of the blades 110 at a given radial distance $D_R$ (see FIG. 3) from the rotational axis 112. For example, when the radial distance $D_R$ (see FIG. 3) from the rotational axis 112 along the rotationally leading surface 172 is plotted against the angular distance $D_\theta$ between adjacent, rotationally leading surfaces 172, it may be seen that the average distance between rotationally adjacent blades may differ significantly and that the absolute distance between cutting elements 116 within one region 122 through 128 may also differ significantly from the distance between cutting elements 116 in other regions 122 through 128. The radial distance $D_R$ may be measured by determining a magnitude of a distance from the rotational axis 112 to a rotationally leading surface 172 of a given blade 110 in a plane perpendicular to the rotational axis 112. The angular distance $D_\theta$ may be measured by determining an included angle between a rotationally leading surface 172 of a rotationally leading blade 110 and a rotationally leading surface of an adjacent, rotationally trailing blade 110.

Figure 9:
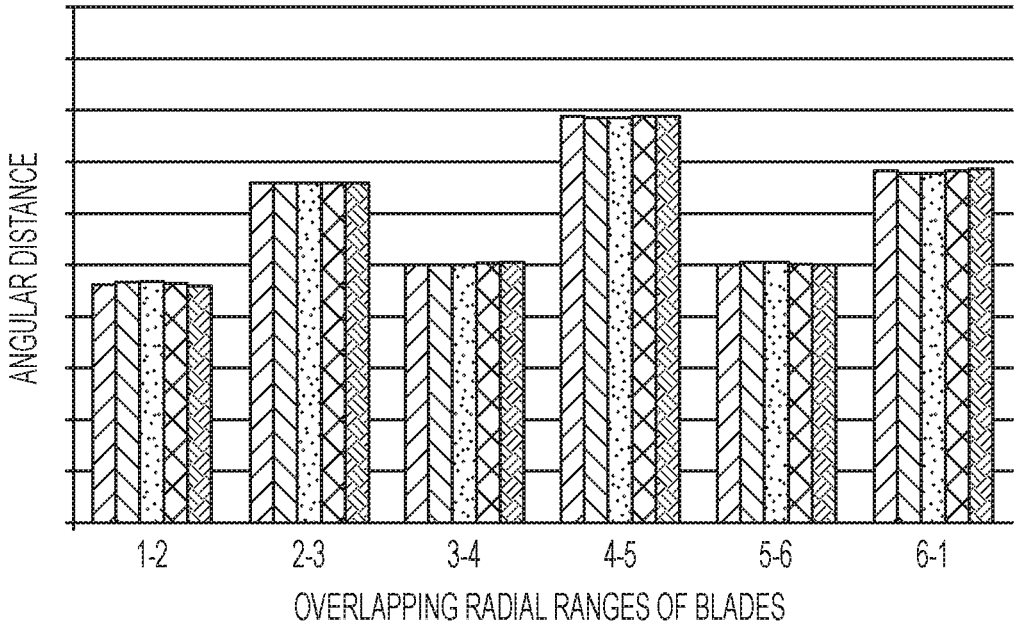
FIG. 9 is a bar graph depicting groups of angular distances between cutting elements on circumferentially adjacent blades of a conventional earth-boring tool.

FIG. 9 is a bar graph depicting an angular distance between rotationally leading surfaces of circumferentially adjacent blades of a conventional earth-boring tool. The earth-boring tool may include blades having at least substantially no difference in radius of curvature from blade to blade. As shown in FIG. 9, although there may be some degree of variance in spacing from blade to blade, the angular spacing between the rotationally leading surfaces of rotationally adjacent blades may be at least substantially uniform. For example, a variance index of the rotationally leading surfaces of rotationally adjacent blades for the conventional earth-boring tool may be low. The variance index may be calculated according to the following formula:

$$\text{Variance Index} = \text{Average}\left(\sum_{i=1}^{n} \frac{\sigma_i}{\mu_i}\right)$$

In the foregoing equation, i may represent a discrete radial range within which the operation is being performed (e.g., within one of the regions 122 through 128 (see FIG. 2) combinations of the regions 122 through 128 (see FIG. 2), a subsection or subsections of one or more of the regions 122 through 128 (see FIG. 2), or combinations of one or more of the regions 122 through 128 (see FIG. 2) with a subsection or subsections of one or more of the other regions 122 through 128 (see FIG. 2)), n may represent the total number of radial ranges over which the measurements are taken, $\sigma$ may represent the standard deviation of angular distances between rotationally leading surfaces of rotationally adjacent blades within the given discrete radial range, and $\mu$ may represent the average of angular distances between rotationally leading surfaces of rotationally adjacent blades within the given discrete radial range. The resulting number may be a unitless number representing an average percent change in angular distance between rotationally leading surfaces of rotationally adjacent blades within the rotationally overlapping portions of the various blades.

The variance index for the conventional earth-boring tool may be, for example, less than 5%. More specifically, the variance index for the conventional earth-boring tool may be, for example, between about 1% and about 4%. As a specific, nonlimiting example, the variance index for the conventional earth-boring tool may be between about 2% and about 3% (e.g., about 3%).

Figure 10:
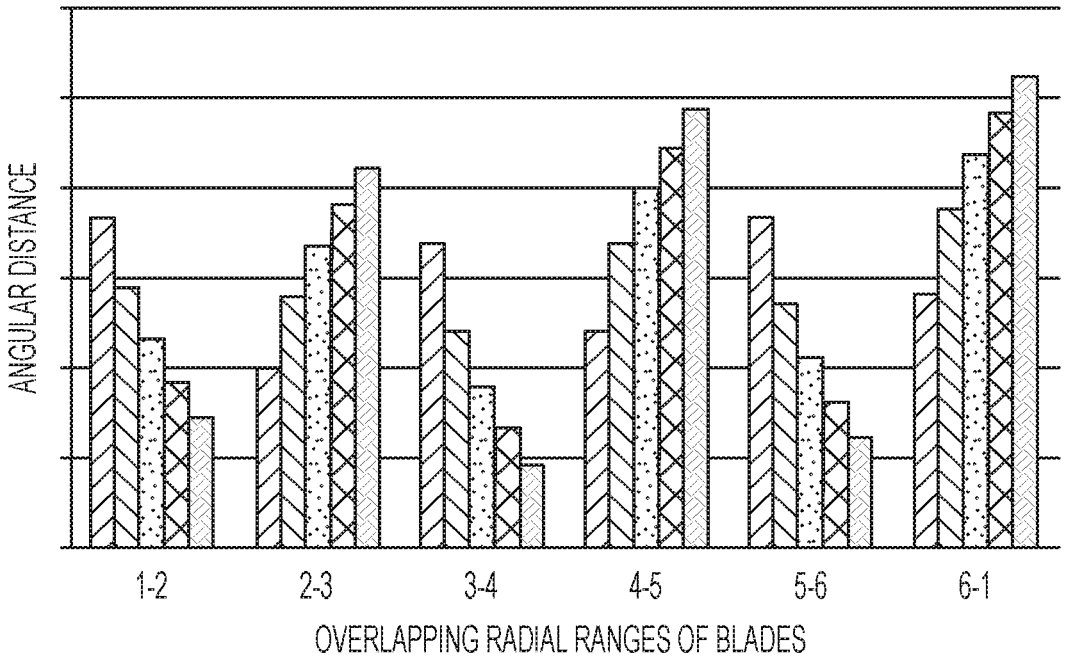
FIG. 10 is a bar graph depicting an angular distance between cutting elements on circumferentially adjacent blades of an embodiment of an earth-boring tool in accordance with this disclosure.

FIG. 10 is a bar graph depicting an angular distance between cutting elements on circumferentially adjacent blades of an embodiment of an earth-boring tool in accordance with this disclosure. As shown in FIG. 10, there may be greater variance in the angular distance between rotationally adjacent cutting elements, which may result at least in part from the differences in radius of curvature of the various blades. For example, the variance index of the cutting elements for the earth-boring tool in accordance with this disclosure may be high. The variance index for the earth-boring tool in accordance with this disclosure may be, for example, greater than or equal to 5%. More specifically, the variance index for the earth-boring tool in accordance with this disclosure may be, for example, between 5% and about 30%. As a specific, nonlimiting example, the variance index for the earth-boring tool in accordance with this disclosure may be between about 10% and about 20% (e.g., about 15%). Although some specifics for upper limits on the variance index are disclosed, the only true upper limit on the variance index may be the size of the junk slots. For example, very large differences in the radiuses of curvature of the blades may reduce the size the junk slots, potentially to the point where cuttings become lodged in the junk slots, rather than being cleared therefrom.

Figure 11:
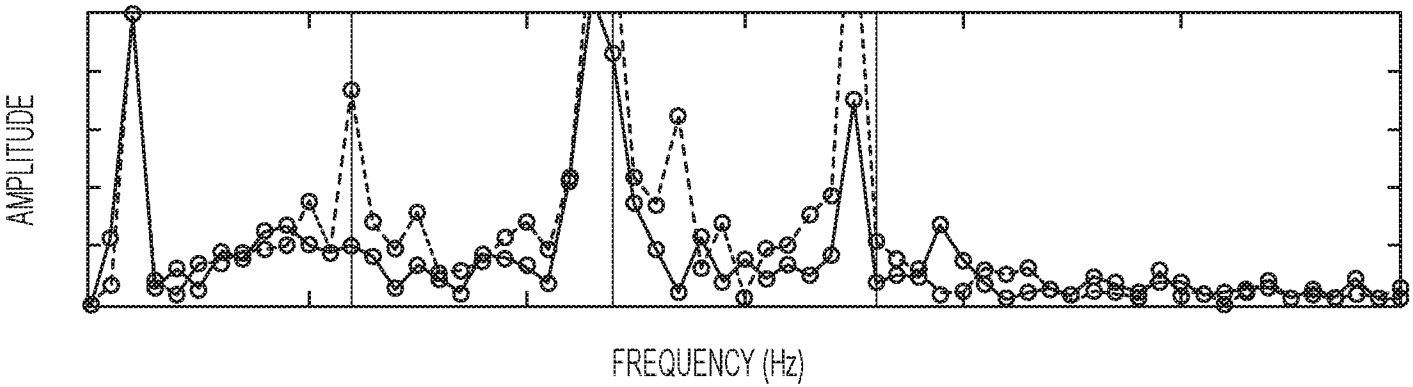
FIG. 11 is a graph of a measured vibrational response of a conventional earth-boring tool during drilling.

FIG. 11 is a graph of a measured vibrational response of a conventional earth-boring tool during drilling. For example, the conventional earth-boring tool may have been used to drill in a subterranean formation, and one or more vibrational sensors may have been used to detect the amplitude and frequency of the vibration of the drill string. More specifically, an accelerometer or a laser may be used to measure acceleration or position of the drill string at the surface as the earth-boring tool is used to drill in a borehole. As shown in FIG. 11, the conventional earth-boring drill bit caused the drill string to vibrate at high amplitudes with strong, harmonic vibrational responses being clustered around several different frequencies.

Figure 12:
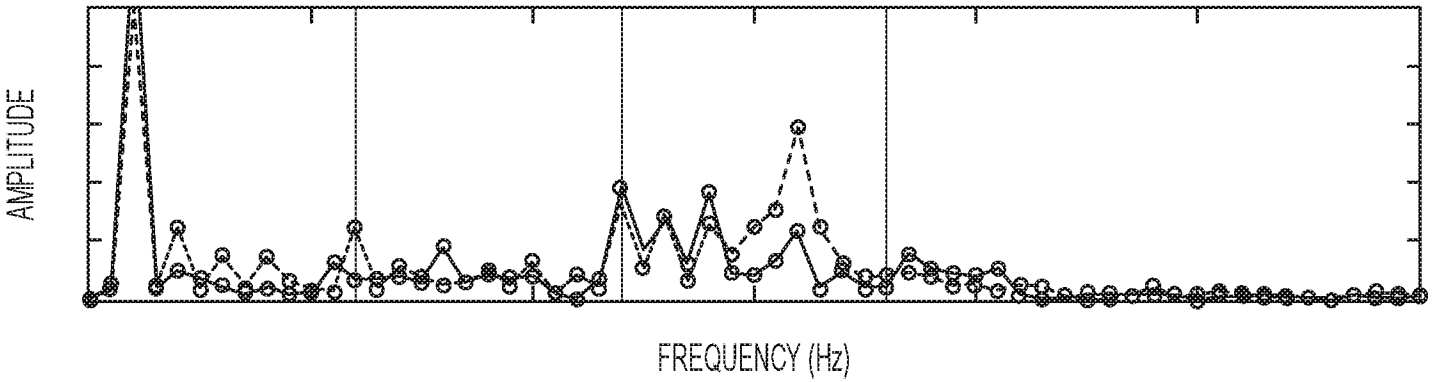
FIG. 12 is a graph of a measured vibrational response of an earth-boring tool in accordance with this disclosure during drilling.

FIG. 12 is a graph of a measured vibrational response of an earth-boring tool in accordance with this disclosure during drilling. For example, an earth-boring tool in accordance with this disclosure may have been used to drill in a subterranean formation, and the vibrational sensors may have been used to detect the amplitude and frequency of the vibration of the drill string. As shown in FIG. 12, the earth-boring tool in accordance with this disclosure exhibited lower peak amplitude vibrations, and a reduction in the harmonic response. It is believed that the increase in variance in angular distance between rotationally adjacent cutting elements, which results at least in part from the differences in radius of curvature between the blades, may be a significant factor in damping the vibrational response of the drill string. Such a reduction in vibrational response may produce reduced impact and dynamics on the drill string and components thereof, in addition to greater control over the direction of drilling, each of which may increase the useful life and efficiency of the earth-boring tool.

For example, a peak amplitude at which a drill string including an earth-boring tool in accordance with this disclosure may vibrate at frequencies in Hz that are multiples of n blades multiplied by rpm/60 that may be about 75% or less of a peak amplitude at which a drill string including a conventional earth-boring tool may vibrate at frequencies in Hz that are multiples of n blades multiplied by rpm/60. More specifically, the peak amplitude at which the drill string including the earth-boring tool in accordance with this disclosure may vibrate at frequencies in Hz that are multiples of n blades multiplied by rpm/60 may be between about 50% and about 60% of the peak amplitude at which the drill string including the conventional earth-boring tool may vibrate at frequencies in Hz that are multiples of n blades multiplied by rpm/60. As a specific, nonlimiting example, the peak amplitude at which the drill string including the earth-boring tool in accordance with this disclosure may vibrate at frequencies in Hz that are multiples of n blades multiplied by rpm/60 may be about 55% of the peak amplitude at which the drill string including the conventional earth-boring tool may vibrate at frequencies in Hz that are multiples of n blades multiplied by rpm/60.

Additional, nonlimiting embodiments within the scope of this disclosure include the following:

Embodiment 1

An earth-boring tool, comprising: a body; blades extending outward from the body; and cutting elements secured to the blades; wherein an entirety of a first blade exhibits a first, constant or continuously variable radius of curvature different from a second, constant or continuously variable radius of curvature of an entirety of a second blade.

Embodiment 2

The earth-boring tool of Embodiment 1, wherein a number of first blades exhibiting the first radius of curvature is equal to a number of second blades exhibiting the second radius of curvature.

Embodiment 3

The earth-boring tool of Embodiment 1, wherein a number of first blades exhibiting the first radius of curvature is different from a number of second blades exhibiting the second radius of curvature.

Embodiment 4

The earth-boring tool of any one of Embodiments 1 through 4, wherein the first blade comprises a primary blade and the second blade comprises a secondary blade.

Embodiment 5

The earth-boring tool of Embodiment 4, wherein the first radius of curvature is between about 125% and about 7,500% of the second radius of curvature.

Embodiment 6

The earth-boring tool of Embodiment 4, wherein the first radius of curvature is between about 0% and about 80% of the second radius of curvature.

Embodiment 7

The earth-boring tool of Embodiment 4, wherein the first radius of curvature is greater than about 15 inches and the second radius of curvature is between about 1 inch and about 12 inches.

Embodiment 8

The earth-boring tool of Embodiment 4, wherein the first radius of curvature is between about 1 inches i inch and about 12 inches and the second radius of curvature is between about 25 inches and about 150 inches.

Embodiment 9

The earth-boring tool of any one of Embodiments 1 through 8, wherein a variance index of the earth-boring tool is between 5% and about 30%.

Embodiment 10

The earth-boring tool of any one of Embodiments 1 through 9, wherein a peak amplitude at which the earth-boring tool vibrates at frequencies in Hz that are multiples of n blades multiplied by rpm/60 is about 75% or less of a peak amplitude at which a drill string including an earth-boring tool comprising blades having a same radius of curvature vibrates at frequencies in Hz that are multiples of n blades multiplied by rpm/60.

Embodiment 11

A method of making an earth-boring tool, comprising: forming an entirety of a first blade extending outward from a body to exhibit a first, constant or continuously variable radius of curvature; forming an entirety of a second blade extending outward from the body to exhibit a second, different, constant or continuously variable radius of curvature; and securing cutting elements to the first and second blades.

Embodiment 12

The method of Embodiment 11, wherein forming the entirety of the first blade to exhibit the first radius of curvature and forming the at least another portion of the second blade to exhibit the second, different radius of curvature comprises forming first blades comprising portions exhibiting the first radius of curvature in a number equal to a number of second blades comprising portions exhibiting the second radius of curvature.

Embodiment 13

The method of Embodiment 11, wherein forming the entirety of the first blade to exhibit the first radius of curvature and forming the at least another portion of the second blade to exhibit the second, different radius of curvature comprises forming first blades comprising portions exhibiting the first radius of curvature in a number different from a number of second blades comprising portions exhibiting the second radius of curvature.

Embodiment 14

The method of any one of Embodiments 11 through 13, wherein forming the entirety of the first blade to exhibit the first radius of curvature and forming the at least another portion of the second blade to exhibit the second, different radius of curvature comprises forming the first blade to be a primary blade and the second blade to be a secondary blade.

Embodiment 15

The method of Embodiment 14, wherein forming the entirety of the first blade to exhibit the first radius of curvature and forming the at least another portion of the second blade to exhibit the second, different radius of curvature comprises forming the first radius of curvature to be between about 125% and about 7,500% of the second radius of curvature.

Embodiment 16

The method of claim 14, wherein forming the entirety of the first blade to exhibit the first radius of curvature and forming the at least another portion of the second blade to exhibit the second, different radius of curvature comprises forming the first radius of curvature to be between about 0% and about 80% of the second radius of curvature.

Embodiment 17

The method of Embodiment 14, wherein forming the entirety of the first blade to exhibit the first radius of curvature and forming the at least another portion of the second blade to exhibit the second, different radius of curvature comprises forming the first radius of curvature to be greater than about 15 inches and forming the second radius of curvature to be between about 1 inch and about 12 inches.

Embodiment 18

The method of Embodiment 14, wherein forming the entirety of the first blade to exhibit the first radius of curvature and forming the at least another portion of the second blade to exhibit the second, different radius of curvature comprises forming the first radius of curvature to be between about 1 inch and about 12 inches and the second radius of curvature to be greater than about 15 inches.

Embodiment 19

The method of any one of Embodiments 11 through 18, wherein securing the cutting elements to the blades comprises rendering a variance index of the earth-boring tool between 5% and about 30%.

Embodiment 20

A method of drilling an earth formation utilizing an earth-boring tool, comprising: placing an earth-boring tool comprising a body, blades extending outward from the body, and cutting elements secured to the blades into a borehole in the earth formation, wherein an entirety of a first blade exhibits a first, constant or continuously variable radius of curvature different from a second, constant or continuously variable radius of curvature of an entirety of a second blade; and removing an underlying earth formation utilizing the earth-boring tool while maintaining a peak amplitude at which the earth-boring tool vibrates at frequencies in Hz that are multiples of n blades multiplied by rpm/60 at about 75% or less of a peak amplitude at which a drill string including an earth-boring tool comprising blades having a same radius of curvature vibrates at frequencies in Hz that are multiples of n blades multiplied by rpm/60.

Embodiment 21

An earth-boring tool comprising: a body; blades extending outward from the body; and cutting elements secured to the blades; wherein an entirety of a first blade exhibits a first, constant or continuously variable radius of curvature different from a second, constant or continuously variable radius of curvature of an entirety of a second blade.

Embodiment 22:

The earth-boring tool of Embodiment 21, wherein an entirety of a third blade exhibits a third, constant or continuously variable radius of curvature different from the first radius of curvature and the second radius of curvature.

Embodiment 23:

The earth-boring tool of Embodiment 22, wherein an entirety of a fourth blade exhibits a fourth, constant or continuously variable radius of curvature different from the first radius of curvature, the second radius of curvature, and the third radius of curvature.

Embodiment 24:

The earth-boring tool of Embodiment 21, wherein an entirety of each blade exhibits a radius of curvature different from a radius of curvature of each other blade.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. An earth-boring tool, comprising:

a body;

blades extending outward from the body; and cutting elements secured to the blades;

wherein an entirety of a first blade exhibits a first, constant or continuously variable radius of curvature different from a second, constant or continuously variable radius of curvature of an entirety of a second blade; and wherein a variance index of the earth-boring tool is between 5% and about 30%.

2. The earth-boring tool of claim 1, wherein a number of first blades exhibiting the first radius of curvature is equal to a number of second blades exhibiting the second radius of curvature.

3. The earth-boring tool of claim 1, wherein a number of first blades exhibiting the first radius of curvature is different from a number of second blades exhibiting the second radius of curvature.

4. The earth-boring tool of claim 1, wherein the first blade comprises a primary blade and the second blade comprises a secondary blade.

5. The earth-boring tool of claim 4, wherein the first radius of curvature is between about 125% and about 7,500% of the second radius of curvature.

6. The earth-boring tool of claim 4, wherein the first radius of curvature is between about 0% and about 80% of the second radius of curvature.

7. The earth-boring tool of claim 4, wherein the first radius of curvature is greater than about 15 inches and the second radius of curvature is between about 1 inch and about 12 inches.

8. The earth-boring tool of claim 4, wherein the first radius of curvature is between about 1 inches and about 12 inches and the second radius of curvature is between about 25 inches and about 150 inches.

9. The earth-boring tool of claim 1, wherein a peak amplitude at which the earth-boring tool vibrates at frequencies in Hz that are multiples of n blades multiplied by rpm/60 is about 75% or less of a peak amplitude at which a drill string including an earth-boring tool comprising blades having a same radius of curvature vibrates at frequencies in Hz that are multiples of n blades multiplied by rpm/60.

10. A method of making an earth-boring tool, comprising:

forming an entirety of a first blade extending outward from a body to exhibit a first, constant or continuously variable radius of curvature;

forming an entirety of a second blade extending outward from the body to exhibit a second, different, constant or continuously variable radius of curvature; and securing cutting elements to the first and second blades and rendering a variance index of the earth-boring tool between 5% and about 30%.

11. The method of claim 10, wherein forming the entirety of the first blade to exhibit the first radius of curvature and forming at least a portion of the second blade to exhibit the second, different radius of curvature comprises forming first blades comprising portions exhibiting the first radius of curvature in a number equal to a number of second blades comprising portions exhibiting the second, different radius of curvature.

12. The method of claim 10, wherein forming the entirety of the first blade to exhibit the first radius of curvature and forming at least a portion of the second blade to exhibit the second, different radius of curvature comprises forming first blades comprising portions exhibiting the first radius of curvature in a number different from a number of second blades comprising portions exhibiting the second, different radius of curvature.

13. The method of claim 10, wherein forming the entirety of the first blade to exhibit the first radius of curvature and forming at least a portion of the second blade to exhibit the second, different radius of curvature comprises forming the first blade to be a primary blade and the second blade to be a secondary blade.

14. The method of claim 13, wherein forming the entirety of the first blade to exhibit the first radius of curvature and forming the at least the portion of the second blade to exhibit the second, different radius of curvature comprises forming the first radius of curvature to be between about 125% and about 7,500% of the second, different radius of curvature.

15. The method of claim 13, wherein forming the entirety of the first blade to exhibit the first radius of curvature and forming the at least the portion of the second blade to exhibit the second, different radius of curvature comprises forming the first radius of curvature to be between about 0% and about 80% of the second, different radius of curvature.

16. The method of claim 13, wherein forming the entirety of the first blade to exhibit the first radius of curvature and forming the at least the portion of the second blade to exhibit the second, different radius of curvature comprises forming the first radius of curvature to be greater than about 15 inches and forming the second, different radius of curvature to be between about 1 inch and about 12 inches.

17. The method of claim 13, wherein forming the entirety of the first blade to exhibit the first radius of curvature and forming the at least the portion of the second blade to exhibit the second, different radius of curvature comprises forming the first radius of curvature to be between about 1 inch and about 12 inches and the second, different radius of curvature to be greater than about 15 inches.

18. A method of drilling an earth formation utilizing an earth-boring tool, comprising:

placing an earth-boring tool comprising a body, blades extending outward from the body, and cutting elements secured to the blades into a borehole in the earth formation, wherein an entirety of a first blade exhibits a first, constant or continuously variable radius of curvature different from a second, constant or continuously variable radius of curvature of an entirety of a second blade and wherein a variance index of the earth-boring tool is between 5% and about 30%; and removing an underlying earth formation utilizing the earth-boring tool while maintaining a peak amplitude at which the earth-boring tool vibrates at frequencies in Hz that are multiples of n blades multiplied by rpm/60 at about 75% or less of a peak amplitude at which a drill string including an earth-boring tool comprising blades having a same radius of curvature vibrates at frequencies in Hz that are multiples of n blades multiplied by rpm/60.

* * * * *